US009464502B2

(12) United States Patent
Rosas et al.

(10) Patent No.: US 9,464,502 B2
(45) Date of Patent: Oct. 11, 2016

(54) MILL DIVERTER HAVING A SWELLABLE MATERIAL FOR PREVENTING FLUID FLOW PAST THE MATERIAL

(71) Applicant: HALLIBURTON ENERGY SERVICES, INC., Houston, TX (US)

(72) Inventors: Eulalio J. Rosas, Al Khobar (SA); Ernest C. Bailey, Al Khobar (SA)

(73) Assignee: Halliburton Energy Services, Inc., Houston, TX (US)

( * ) Notice: Subject to any disclaimer, the term of this patent is extended or adjusted under 35 U.S.C. 154(b) by 360 days.

(21) Appl. No.: 14/106,076

(22) Filed: Dec. 13, 2013

(65) Prior Publication Data

US 2014/0238701 A1 Aug. 28, 2014

Related U.S. Application Data

(63) Continuation of application No. PCT/US2013/027907, filed on Feb. 27, 2013.

(51) Int. Cl.
*E21B 33/10* (2006.01)
*E21B 33/127* (2006.01)
*E21B 7/06* (2006.01)

(52) U.S. Cl.
CPC ..... *E21B 33/1277* (2013.01); *E21B 7/061* (2013.01)

(58) Field of Classification Search
CPC ..... E21B 7/061; E21B 33/1277
See application file for complete search history.

(56) References Cited

U.S. PATENT DOCUMENTS

| | | | | |
|---|---|---|---|---|
| 6,241,021 | B1 | 6/2001 | Bowling | |
| 6,883,611 | B2 | 4/2005 | Smith et al. | |
| 7,584,795 | B2 * | 9/2009 | Hepburn et al. | 166/313 |
| 2003/0042024 | A1 | 3/2003 | Freeman et al. | |
| 2006/0266531 | A1 | 11/2006 | Hepburn et al. | |
| 2008/0296029 | A1 * | 12/2008 | Ortiz | 166/381 |
| 2011/0073326 | A1 * | 3/2011 | Clemens et al. | 166/382 |

FOREIGN PATENT DOCUMENTS

CN 101498203 A 8/2009

OTHER PUBLICATIONS

Chinese Office Action date mailed Mar. 29, 2016; Chinese Application No. 2013800733222.

* cited by examiner

*Primary Examiner* — Nicole Coy
(74) *Attorney, Agent, or Firm* — McGuireWoods, LLP

(57) ABSTRACT

A method of preventing fluid flow past a tapered face of a mill diverter in a wellbore comprises: positioning the mill diverter in the wellbore, wherein the mill diverter comprises: a body; the tapered face, wherein the tapered face is located at one end of the body; and a swellable material, wherein the swellable material: is positioned circumferentially around the body of the mill diverter adjacent to the tapered face; swells in the presence of a swelling fluid; and prevents substantially all of a fluid from flowing past the swellable material after the swellable material has swelled; and causing or allowing the swellable material to swell. The swellable material can also prevent a loss of pressure in the wellbore above the swellable material or prevent a first fluid having a first density from mixing with a second fluid having a second density after the swellable material has swelled.

20 Claims, 4 Drawing Sheets

MILL DIVERTER HAVING A SWELLABLE MATERIAL FOR PREVENTING FLUID FLOW PAST THE MATERIAL

TECHNICAL FIELD

Mill diverters, such as whipstocks, are used to form lateral wellbores. The mill diverter includes a tapered face such that a mill bit can create a window in a casing and possibly cement. After creation of the window, a drill bit can be used to form the lateral wellbore.

SUMMARY

According to an embodiment, a method of preventing fluid flow past a tapered face of a mill diverter in a wellbore comprises: positioning the mill diverter in the wellbore, wherein the mill diverter comprises: (a) a body; (b) the tapered face, wherein the tapered face is located at one end of the body; and (c) a swellable material, wherein the swellable material: (i) is positioned circumferentially around the body of the mill diverter adjacent to the tapered face; (ii) swells in the presence of a swelling fluid; and (iii) prevents substantially all of a fluid from flowing past the swellable material after the swellable material has swelled; and causing or allowing the swellable material to swell.

According to another embodiment, a method of maintaining a pressure above a mill diverter in a wellbore comprises: positioning the mill diverter in the wellbore, wherein the mill diverter comprises: (a) a body; (b) a tapered face, wherein the tapered face is located at one end of the body; and (c) a swellable material, wherein the swellable material: (i) is positioned circumferentially around the body of the mill diverter adjacent to the tapered face; (ii) swells in the presence of a swelling fluid; and (iii) prevents a loss of pressure in the wellbore at a location above the swellable material after the swellable material has swelled; causing or allowing the swellable material to swell; and maintaining the pressure in the wellbore at a location above the swellable material.

According to another embodiment, the swellable material prevents a first fluid having a first density from mixing with a second fluid having a second density, wherein the first fluid is located above the swellable material in the wellbore and the second fluid is located below the swellable material in the wellbore after the swellable material has swelled.

BRIEF DESCRIPTION OF THE DRAWING

The features and advantages of certain embodiments will be more readily appreciated when considered in conjunction with the accompanying figures. The figures are not to be construed as limiting any of the preferred embodiments.

DETAILED DESCRIPTION OF THE INVENTION

Figure 1:
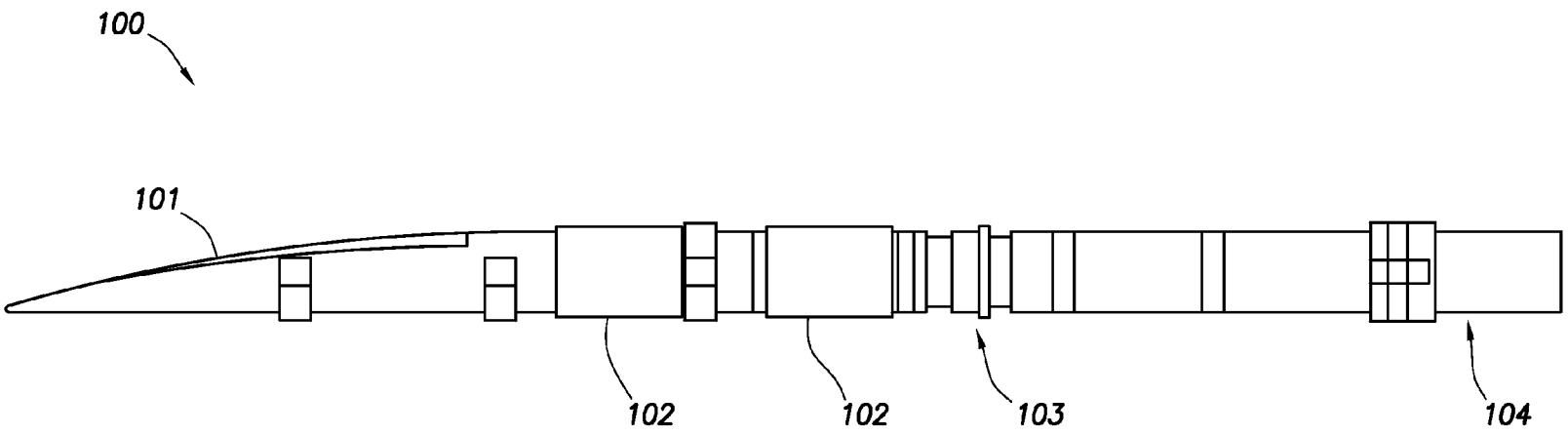
FIG. 1 depicts a mill diverter having a swellable material.

As used herein, the words "comprise," "have," "include," and all grammatical variations thereof are each intended to have an open, non-limiting meaning that does not exclude additional elements or steps.

It should be understood that, as used herein, "first," "second," "third," etc., are arbitrarily assigned and are merely intended to differentiate between two or more fluids, densities, etc., as the case may be, and does not indicate any sequence. Furthermore, it is to be understood that the mere use of the term "first" does not require that there be any "second," and the mere use of the term "second" does not require that there be any "third," etc.

As used herein, the relative term "down", and all grammatical variations thereof, means in a direction away from the wellhead. Conversely, the relative term "up", and all grammatical variations thereof, means in a direction towards the wellhead. Moreover, the term "below" means at a location farther away from the wellhead compared to another location; and the term "above" means at a location closer to the wellhead compared to another location. By way of example, reference to a swellable material being above another component or device means that the material is at a location closer to the wellhead compared to the other component or device.

As used herein, a "fluid" is a substance having a continuous phase that tends to flow and to conform to the outline of its container when the substance is tested at a temperature of 71° F. (22° C.) and a pressure of one atmosphere "atm" (0.1 megapascals "MPa"). A fluid can be a liquid or gas. A homogenous fluid has only one phase; whereas a heterogeneous fluid has more than one distinct phase. A solution is an example of a homogenous fluid, containing a solvent (e.g., water) and a solute. A colloid is an example of a heterogeneous fluid. A colloid can be: a slurry, which includes an external liquid phase and undissolved solid particles as the internal phase; an emulsion, which includes an external liquid phase and at least one internal phase of immiscible liquid droplets; a foam, which includes an external liquid phase and a gas as the internal phase; or a mist, which includes an external gas phase and liquid droplets as the internal phase. There can be more than one internal phase of a colloid, but only one external phase. For example, there can be an external phase, which is adjacent to a first internal phase, and the first internal phase can be adjacent to a second internal phase. Any of the phases of a colloid can contain dissolved materials and/or undissolved solids. The external phase of a colloid can also be called the base fluid.

Oil and gas hydrocarbons are naturally occurring in some subterranean formations. A subterranean formation containing oil or gas is sometimes referred to as a reservoir. A reservoir may be located under land or off shore. Reservoirs are typically located in the range of a few hundred feet (shallow reservoirs) to a few tens of thousands of feet (ultra-deep reservoirs). In order to produce oil or gas, a well is drilled into a subterranean formation.

A well can include, without limitation, an oil, gas, or water production well, or an injection well. As used herein, a "well" includes at least one wellbore. A wellbore can include vertical, inclined, and horizontal portions, and it can be straight, curved, or branched. As used herein, the term "wellbore" includes any cased, and any uncased, open-hole portion of the wellbore. It is common for a well to include a primary wellbore and one or more lateral wellbores extending from the primary wellbore. As used herein, the term "wellbore" also means any wellbore whether it be a primary wellbore or a lateral wellbore. As used herein, "into a well" means and includes into any portion of a wellbore, including into a primary wellbore and/or into one or more lateral wellbores.

A drill bit can be used to form a primary wellbore. A drill string can be used to aid the drill bit in drilling through the subterranean formation to form the wellbore. The drill string can include a drilling pipe. During drilling operations, a drilling fluid, sometimes referred to as a drilling mud, may be circulated downwardly through the drilling pipe, and back up the annulus between the wall of the wellbore and the outside of the drilling pipe. The drilling fluid performs various functions, such as cooling the drill bit, maintaining the desired pressure in the well, and carrying drill cuttings upwardly through the wellbore annulus.

After the primary wellbore is drilled, a tubing string, called casing, can be placed into the wellbore. The casing can be cemented in the wellbore by introducing a cement composition in the annulus between the wall of the wellbore and the outside of the casing. The cement can help stabilize and secure the casing in the wellbore.

It is often desirable to form one or more lateral wellbores extending into a subterranean formation from a primary wellbore. A lateral wellbore can be created in a vertical, inclined, or horizontal portion of the primary wellbore or in multiple locations of combinations thereof. In order to form a lateral wellbore, a window can first be created. This is generally accomplished by placing a mill in the primary wellbore. The mill includes a mill bit, which can be the same as, or similar to, the drill bit that was used to form the primary wellbore. The mill can be attached to a drill string, which is located inside the casing. A drilling fluid is circulated downwardly through the drill string and up through the annular space between the outside of the drill string and the inside of the casing. A mill diverter can be placed at a location adjacent to the desired window location. An example of a common mill diverter is a whipstock. The mill diverter includes a sloped portion, commonly called a tapered face, where the sloped portion is much like the hypotenuse of a right triangle. The mill diverter commonly includes a fishing or retrieval mechanism and a setting or anchoring mechanism. The fishing mechanism can be used to remove the mill diverter after the mill diverter is no longer needed. The setting mechanism can be used to secure the mill diverter to the inside of the casing and help the diverter remain stationary.

The mill is then advanced through the primary wellbore until it engages the tapered face of the mill diverter. The mill is then directed laterally, i.e., in a direction away from a central axis of the primary wellbore, towards the casing. The grade of the sloped portion of the mill diverter can dictate how quickly the mill comes in contact with the casing and also the length of the window. The mill is advanced down the mill diverter until the mill has cut through the casing and the cement, and penetrates the subterranean formation. The mill bit, or a different drill bit, can be used to extend the lateral wellbore a desired distance into the subterranean formation. A casing or liner can then be inserted into the lateral wellbore. The casing or liner can be connected to the casing in the primary wellbore such that fluid is directed from the lateral wellbore and into the primary wellbore (or vice versa), without fluid leakage into the formation. The casing or liner can also be cemented in the lateral wellbore in the same manner as cementing was performed in the primary wellbore.

Of course there can be more than one lateral wellbore formed. There can also be one or more secondary laterals that extend off of a primary lateral to create a branching network of wellbores. As used herein, the term "lateral wellbore" means a wellbore that extends off of a primary wellbore or off of another lateral wellbore, for example, a secondary, tertiary, and so on, lateral wellbore.

Several issues can arise during lateral wellbore formation. Generally, after a mill diverter is positioned in a wellbore, fluids can by-pass the mill diverter and flow from an area above the mill diverter, past the mill diverter, and into a section of the wellbore located below the diverter. This fluid by-pass can cause several problems. First, some fluids can be detrimental to the mechanisms of the mill diverter. For example, some wellbore fluids can be corrosive or erosive to the mechanisms or generally impair proper functioning of the mechanisms. Moreover, for cementing operations, by-pass of the cement below the tapered face can render removal of the diverter impractical as the cement can harden and set around the fishing mechanism. Second, for a given operation (e.g., milling, drilling, stimulation, cementing, etc.) the amount of fluid needed to perform that operation is calculated before the operation commences. A loss of fluid into wellbore portions below the mill diverter can render such calculations meaningless and increase the overall amount of fluid needed for the operation. By way of example, if a window has been formed and a drilling operation is needed to extend a lateral wellbore into the subterranean formation, and if the drilling fluid is lost below the mill diverter, then the volume of drilling fluid required for drilling the lateral is increased above the calculated volume. Third, by-pass of a fluid below the mill diverter can cause a loss of pressure in a desired wellbore portion. For example, a fluid having a higher density could mix with another fluid having a lower density and cause a loss in the desired pressure from the different fluids in the wellbore portion. Fourth, cleaning operations for removal of solid debris generated during wellbore formation are also ineffective if there is a loss of containment of the area to be cleaned or the loss of control over the volume and rate at which the fluid is applied.

Therefore, there is a need to eliminate a fluid by-pass and maintain predictable areas of operations in a wellbore and also to protect the functionality of wellbore tool components for lateral mill diverters (such as multi-lateral whipstocks), down-hole milling apparatuses, single and dual bore deflectors, through-tubing lateral re-entry windows, and re-entry milling and lateral wellbore reference anchors.

It has been discovered that a swellable material can be placed on the body of diverter. The swellable material can swell in the presence of a fluid and create a seal in an annular space between the inside wall of a casing and the outside body of the diverter in the wellbore. The swellable material can be selected such that it is capable of preventing fluid by-pass, capable of withstanding a pressure exerted on the swellable material, and also insusceptible to corrosive or erosive fluids. The swellable material can be axially constrained on the top and bottom such that the swellable material expands in a radial direction only. As the swellable element swells, it expands radially and seals the annular space.

According to an embodiment, a method of preventing fluid flow past a tapered face of a mill diverter in a wellbore comprises: positioning the mill diverter in the wellbore, wherein the mill diverter comprises: (a) a body; (b) the tapered face, wherein the tapered face is located at one end of the body; and (c) a swellable material, wherein the swellable material: (i) is positioned circumferentially around the body of the mill diverter adjacent to the tapered face; (ii) swells in the presence of a swelling fluid; and (iii) prevents substantially all of a fluid from flowing past the swellable material after the swellable material has swelled; and causing or allowing the swellable material to swell.

According to another embodiment, a method of maintaining a pressure above a mill diverter in a wellbore comprises: positioning the mill diverter in the wellbore, wherein the mill diverter comprises: (a) a body; (b) a tapered face, wherein the tapered face is located at one end of the body; and (c) a swellable material, wherein the swellable material: (i) is positioned circumferentially around the body of the mill diverter adjacent to the tapered face; (ii) swells in the presence of a swelling fluid; and (iii) prevents a loss of pressure in the wellbore at a location above the swellable material after the swellable material has swelled; causing or allowing the swellable material to swell; and maintaining the pressure in the wellbore at a location above the swellable material.

According to another embodiment, the swellable material prevents a first fluid having a first density from mixing with a second fluid having a second density, wherein the first fluid is located above the swellable material in the wellbore and the second fluid is located below the swellable material in the wellbore after the swellable material has swelled.

Figure 2:
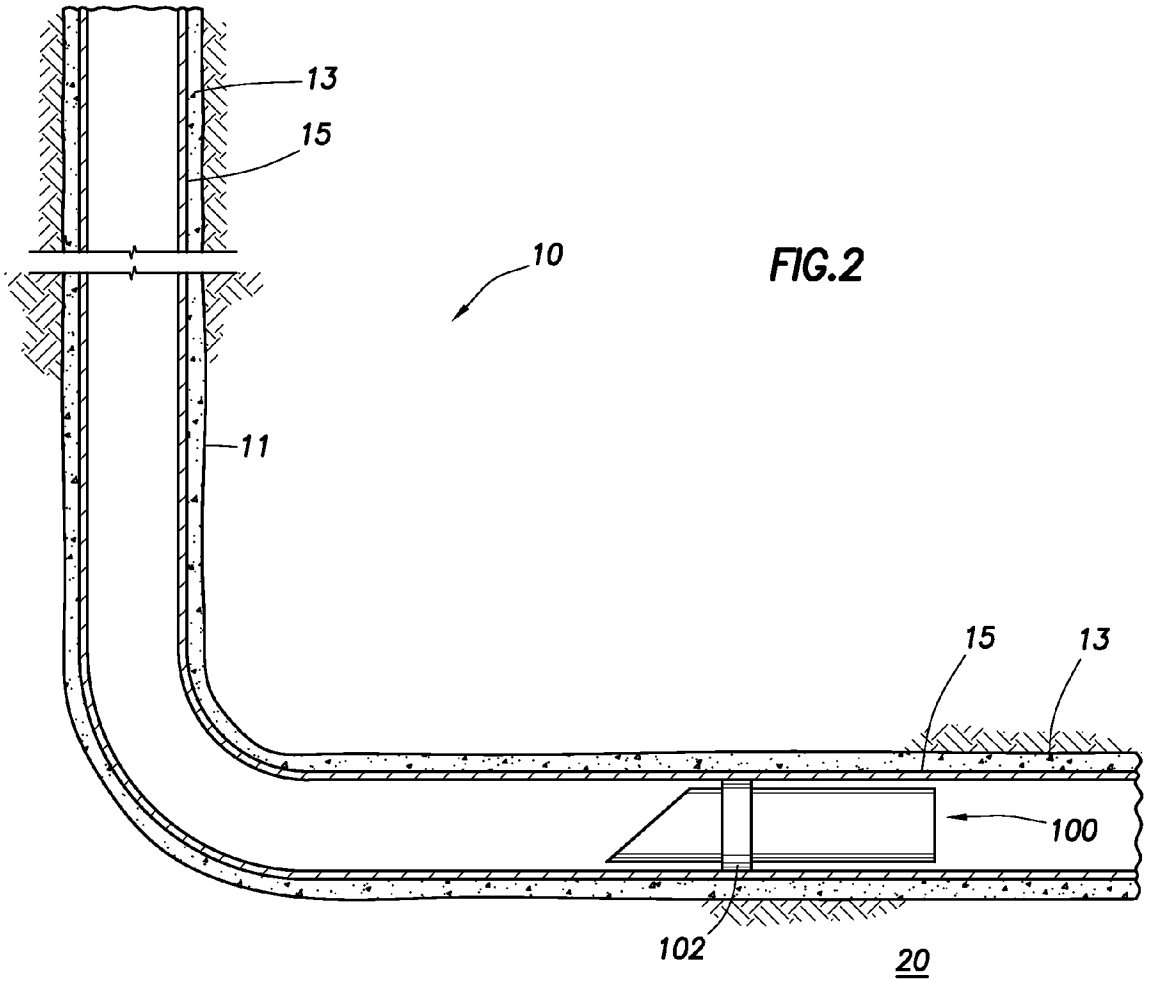
FIG. 2 depicts the mill diverter positioned in a wellbore wherein the swellable material has swelled.
Figure 3:
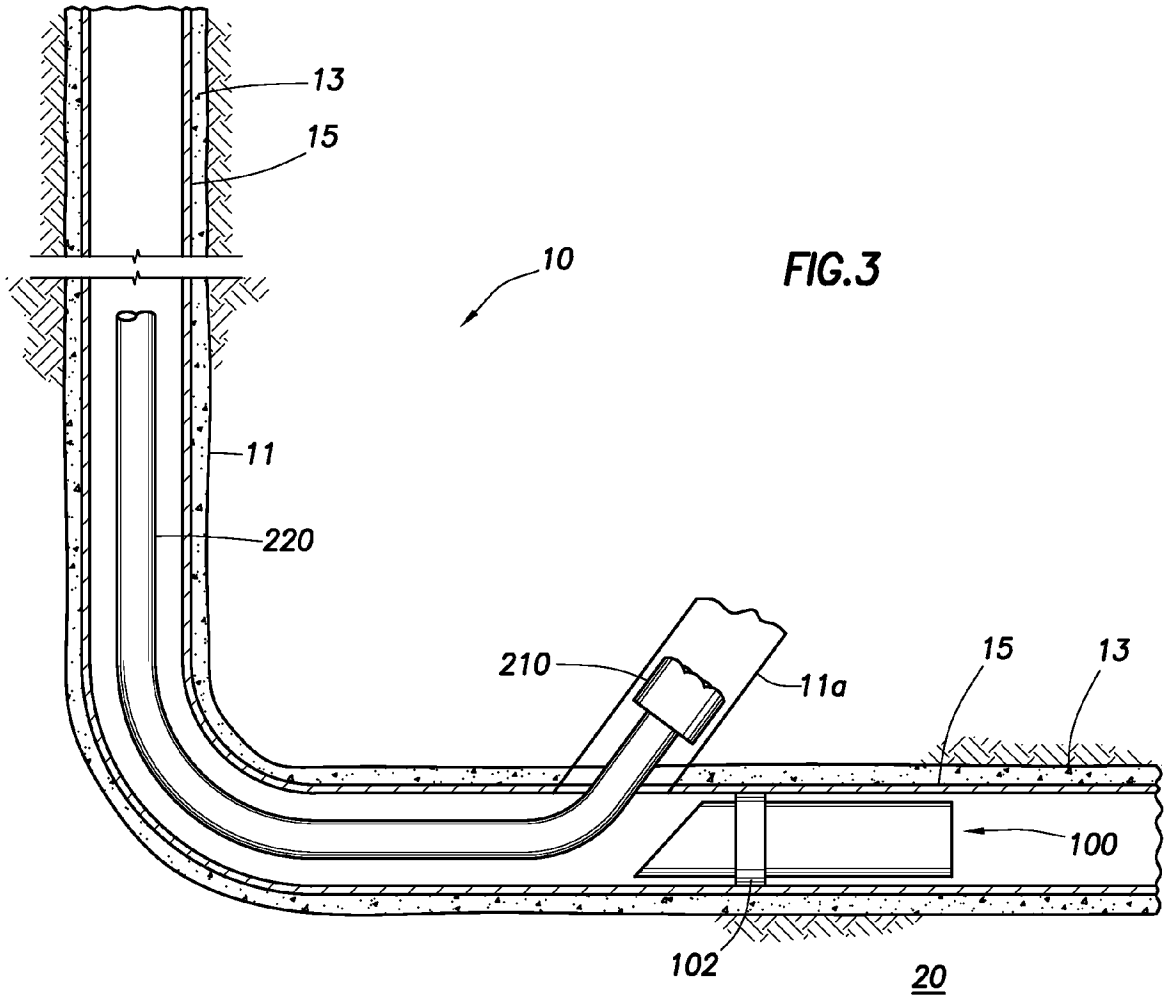
FIG. 3 illustrates a lateral wellbore being formed using the mill diverter.
Figure 4:
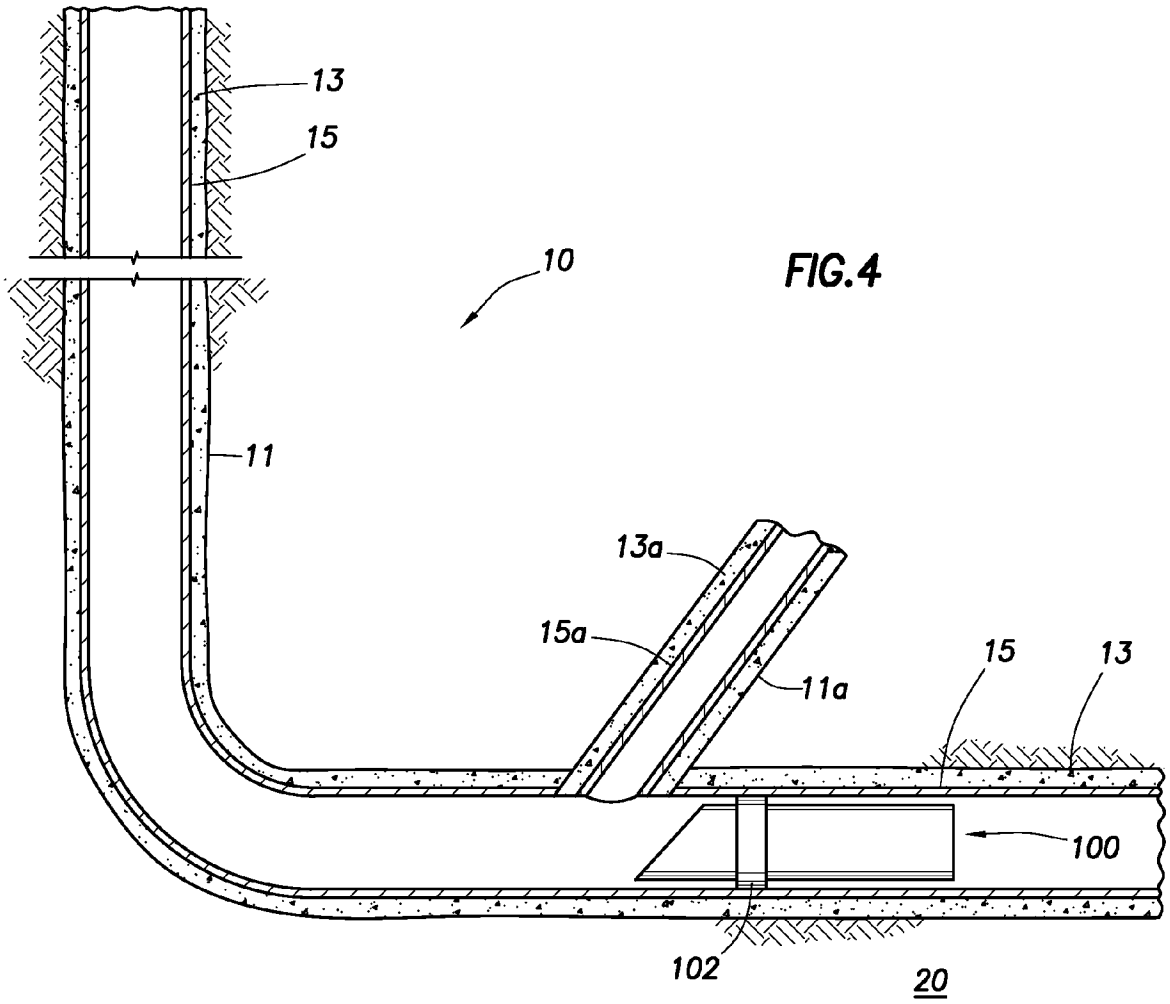
FIG. 4 depicts the lateral wellbore completed.

Turning to the Figures, FIG. 1 depicts the mill diverter 100. FIGS. 2-4 depict the mill diverter 100 in a wellbore 11. The wellbore 11 can be part of a well system 10. The wellbore 11 extends down into a subterranean formation 20. The wellbore 11 can be a primary wellbore or a lateral wellbore. The wellbore 11 can have vertical, horizontal, inclined, straight, or curved sections, and combinations thereof. At least a section of the wellbore 11 is a cased-hole wellbore. The cased-hole section can include a casing 15. The casing 15 can be cemented in the wellbore 11 via cement 13.

The methods include the step of positioning the mill diverter 100 in the wellbore 11. Of course, more than one mill diverter 100 can be placed in the wellbore 11. An example of a mill diverter 100 is a whipstock. The mill diverter 100 can be placed in the wellbore 11 inside the casing 15. As can be seen in FIG. 1, the mill diverter 100 comprises a body, a tapered face 101, and a swellable material 102. The mill diverter 100 can also comprise a setting mechanism 104. The mill diverter 100 can be secured to the casing 15 via the setting mechanism 104. Examples of suitable setting mechanisms 104 include, but are not limited to, a packer, a latch, a liner hanger, a lock mandrel, an expanded tubular, mechanical slips, or a collet. The setting mechanism 104 can function to secure the mill diverter 100 within the casing 15 at the desired location such that downward and rotational movement of the mill diverter 100 under force is inhibited, and preferably eliminated. The methods can further include the step of securing the mill diverter 100 in the casing 15 adjacent to the desired window location, wherein the step of securing can be performed after the step of positioning the mill diverter 100 in the wellbore 11.

The mill diverter 100 can also include a fishing mechanism 103. The fishing mechanism 103 can be used in conjunction with a fishing tool (not shown) in order to retrieve the mill diverter 100 from the wellbore 11. For example, the fishing mechanism 103 can include recessed portions that correspond to raised portions on the fishing tool, such that the fishing tool can engage with the fishing mechanism 103 and the tool can latch onto the mechanism. The mill diverter 100 can then be removed from the wellbore 11.

The mill diverter 100 also comprises the swellable material 102. The swellable material 102 is positioned circumferentially around the body of the mill diverter 100 adjacent to the tapered face 101. The mill diverter 100 can also comprise two or more swellable materials 102. Preferably, the swellable material 102 is positioned circumferentially around the body of the mill diverter 100 at a location between the tapered face 101 and any mechanisms of the diverter (e.g., the setting mechanism 104 and the fishing mechanism 103). In this manner, after swelling, fluid is prevented from coming in contact with the mechanisms of the mill diverter 100.

The length of the swellable material 102 can vary and can be selected such that the desired sealing area around the body of the mill diverter 100 is achieved. The inner diameter of the swellable material 102 can be selected such that the swellable material 102 fits around the outer diameter of the mill diverter 100 body. The typical inner diameter of a swellable material 102 can range from 1 inch to 16 inches as required by the outer diameter of the mill diverter in the application. The thickness of a swellable element is the difference between the largest outer diameter and the inner diameter of the swellable material 102, measured at the axial location of the largest outer diameter.

The swellable material 102 swells in the presence of a swelling fluid. The swellable material 102 can swell in the presence of a hydrocarbon liquid (hydrocarbon-swellable materials) or swell in the presence of an aqueous liquid (water-swellable materials). According to an embodiment, the swellable material is a hydrocarbon liquid swellable material, and the material is selected from the group consisting of natural rubbers, nitrile rubbers, hydrogenated nitrile rubber, acrylate butadiene rubbers, polyacrylate rubbers, isoprene rubbers, chloroprene rubbers, butyl rubbers (IIR), brominated butyl rubbers (BIIR), chlorinated butyl rubbers (CIIR), chlorinated polyethylenes (CM/CPE), neoprene rubbers (CR), styrene butadiene copolymer rubbers (SBR), sulphonated polyethylenes (CSM), ethylene acrylate rubbers (EAM/AEM), epichlorohydrin ethylene oxide copolymers (CO, ECO), ethylene-propylene rubbers (EPM and EDPM), ethylene-propylene-diene terpolymer rubbers (EPT), ethylene vinyl acetate copolymer, acrylonitrile butadiene rubbers, hydrogenated acrylonitrile butadiene rubbers (HNBR), fluorosilicone rubbers (FVMQ), silicone rubbers (VMQ), poly 2,2,1-bicyclo heptenes (polynorbornene), alkylstyrenes, and combinations thereof. One example of a suitable swellable elastomer comprises a block copolymer of a styrene butadiene rubber.

According to another embodiment, the swellable material is a water-swellable material. Some specific examples of suitable water-swellable materials, include, but are not limited to starch-polyacrylate acid graft copolymer and salts thereof, polyethylene oxide polymer, carboxymethyl cellulose type polymers, polyacrylamide, poly(acrylic acid) and salts thereof, poly(acrylic acid-co-acrylamide) and salts thereof, graft-poly(ethylene oxide) of poly(acrylic acid) and salts thereof, poly(2-hydroxyethyl methacrylate), poly(2-hydroxypropyl methacrylate), and combinations thereof. In certain embodiments, the water-swellable material may be cross-linked and/or lightly cross-linked. Other water-swellable materials that behave in a similar fashion with respect to aqueous fluids may also be suitable. The previous lists disclosing suitable swellable materials is by no means an exhaustive list, does not include every suitable swellable material example that could be given, and is not meant to limit the scope of the invention. The swellable material 102 can be selected such that it is insusceptible to corrosive or erosive fluids. For example, the swellable material does not degrade and maintains integrity.

The swelling fluid can be a hydrocarbon liquid or an aqueous liquid. As used herein, a "hydrocarbon liquid"

means a solution or colloid in which a liquid hydrocarbon is the solvent or base fluid. As used herein, an "aqueous liquid" means a solution or colloid in which water is the solvent or base fluid. The swelling fluid can also contain dissolved compounds or undissolved compounds. For a colloid, the swelling fluid can be an emulsion, a slurry, or a foam.

The methods include the step of causing or allowing the swellable material 102 to swell. The step of causing can include introducing the swelling fluid into the wellbore 11 after the steps of positioning the mill diverter 100 in the wellbore 11 and/or after the step of securing the mill diverter 100 to the casing 15. The swelling fluid can then come in contact with the swellable material 102, which causes the swellable element to begin swelling. The step of allowing can include allowing the swellable material 102 to come in contact with a swelling fluid, for example, a reservoir fluid or a fluid already present in the wellbore.

The swelling of the swellable material 102 can be delayed for a desired period of time. The desired period of time can be the time it takes to position the mill diverter 100 in the wellbore 11 and also possibly secure the mill diverter 100 to the casing 15. The delay of swelling can be accomplished by a variety of means. For example, the swellable material 102 and/or the thickness of the swellable material can be selected such that swelling occurs at a desired time or rate, or the swellable material can be fully or partially coated such that the swelling fluid is delayed from coming in contact with the swellable material. The coating can be a compound, such as a wax, thermoplastic, sugar, salt, or polymer. The coating can be selected such that the coating either dissolves in wellbore fluids or melts at a certain temperature. Upon dissolution or melting, at least a portion of the swellable material is available to come in contact with the swelling fluid. One of ordinary skill in the art will be able to select the best method for delaying the swelling based on the specific conditions of the well. As used herein, the term "bottom-hole" means at a location that the mill diverter is positioned.

According to an embodiment, the swellable material 102 prevents substantially all of a fluid from flowing past the swellable material 102 after the swellable material has swelled. Preferably, the swellable material 102 swells at least a sufficient amount such that the swellable material 102 creates a seal in the annulus of the wellbore 11. Preferably, the thickness of the swellable material 102 swells at least 5%, preferably at least 20%, in volume after contact with the swelling fluid. The swellable material 102 can be axially constrained on the top and/or bottom such that the swellable material expands in a radial direction only. As the swellable material swells, it expands radially and seals the annulus. The swellable material 102 is said to prevent "substantially all of a fluid" from flowing past the swellable material to provide for the possibility that some minute and unintentional quantities of fluid may flow past the swellable material. Such trace amounts of fluid may unintentionally flow past the swellable material. However the trace amounts that may be present should not be so great as to render the swelled swellable material ineffective as a seal. According to an embodiment, the swelling fluid is allowed to remain in contact with the swellable material 102 for a sufficient time for the swellable material to swell and expand to a sufficient size. The sufficient size can be a size such that the seal is created. Preferably, the seal is maintained for the time necessary to complete the oil or gas operation. The seal and the prevention of fluid flow around the swellable material can help protect any mechanisms of the mill diverter from becoming damaged. For example, during cementing of a lateral wellbore that is formed above the mill diverter, if the cement were able to flow past the swellable material, then the cement could set and damage any mechanisms, or could also make access to the mechanisms impossible.

According to another embodiment, the swellable material 102 prevents a first fluid having a first density from mixing with a second fluid having a second density, wherein the first fluid is located above the swellable material 102 and the second fluid is located below the swellable material. The first density can be higher or lower than the second density. This method is useful when control of the well system is dependent on different density fluids being maintained in two or more sections of the wellbore. For example, if a lower density fluid is required at the location below the mill diverter and a higher density fluid is required above the mill diverter, then the two fluids are prevented from mixing via fluid by-pass of the swellable material 102 and having each fluid's density change. The prevention of the fluid by-pass allows for greater control over the well system by being able to maintain the desired pressure in each section based on the density of the fluids located in each section.

According to yet another embodiment, the swellable material 102 prevents a loss of pressure in the wellbore 11 at a location above the swellable material after the swellable material has swelled. For example, as seen in FIG. 2, the location above the swellable material is the wellbore from the wellhead down to the swellable material. Preferably, the swellable material 102 is capable of withstanding a specified pressure. As used herein, the term "withstand" and all grammatical variations thereof, means without losing integrity, for example, without losing the component's sealing capability. The swellable material 102 can be capable of withstanding pressures in the range of about 100 to about 1,500 pounds force per square inch (psi). In this manner, by preventing a loss of pressure in the wellbore above the swellable material, operations such as forming a lateral wellbore can be performed without loss of fluid or pressure at the location of the operation. According to certain embodiments, the methods include the step of maintaining the pressure in the wellbore at a location above the swellable material. The step of maintaining can include introducing a fluid into the wellbore.

The methods can further include the step of forming one or more lateral wellbores 11*a* after the step of causing or allowing. A mill bit 210 can be advanced through the wellbore 11 via a tubing string or wireline 220. As can be seen in FIG. 3, the mill bit 210, upon encountering the tapered face 101 of the mill diverter 100, can be diverted away from the center axis of the casing 15. In this manner, the mill bit can start to engage a portion of the casing 15 adjacent to the mill diverter 100. The mill bit can start to break up the casing and the set cement 13. As the mill continues advancing, the window becomes longer. The mill is advanced until the desired window has been formed. The grade of the tapered face 101 of the mill diverter 100 can vary and can be used to help define the length of a window. The mill bit or a drill bit can then be used to form the lateral wellbore 11*a*. As can be seen in FIG. 4, the lateral wellbore can be completed after the step of forming the lateral wellbore. The completion of the lateral wellbore 11*a* can include introducing a casing 15*a* into the lateral wellbore and can also include introducing a cement 13*a* into the annulus between the casing and the wall of the lateral wellbore.

The methods can further include the step of removing the mill diverter from the wellbore after the step of forming the one or more lateral wellbores. The step of removing can include, without limitation, milling a portion of the swelled swellable material 102 or via a wash-over operation in which a burn-shoe and wash-barrel assemblies are used to engage a slip mechanism on the mill diverter 100. Preferably, a sufficient amount of the swellable material 102 is removed such that the fishing mechanism 103 or slip mechanism is accessible. In this manner, a fishing tool can be positioned to engage with the fishing mechanism 103 for removal of the mill diverter 100. It is to be understood that the mill diverter 100 can also be a permanent diverter that is to remain in the wellbore.

The methods can further include the step of producing oil or gas from the subterranean formation 20. The step of producing can be performed after any or all of the following steps: the step of causing or allowing the swellable material to swell, the step of maintaining the pressure on the wellbore, the step of forming a lateral wellbore, and the step of removing the mill diverter from the wellbore. The step of producing can include producing the oil or gas via a production well.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. While compositions and methods are described in terms of "comprising," "containing," or "including" various components or steps, the compositions and methods can also "consist essentially of" or "consist of" the various components and steps. Whenever a numerical range with a lower limit and an upper limit is disclosed, any number and any included range falling within the range is specifically disclosed. In particular, every range of values (of the form, "from about a to about b," or, equivalently, "from approximately a to b,") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an", as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

What is claimed is:

1. A method of preventing fluid flow past a tapered face of a mill diverter in a cased wellbore comprising:

positioning the mill diverter in the cased wellbore, wherein the mill diverter comprises:

(a) a body;

(b) the tapered face, wherein the tapered face is located at one end of the body;

(c) a fishing mechanism; and (d) a swellable material, wherein the swellable material:

(i) is positioned circumferentially around the body of the mill diverter adjacent to the tapered face and disposed between the tapered face and the fishing mechanism;

(ii) swells in the presence of a swelling fluid; and (iii) prevents substantially all of a fluid from flowing past the swellable material after the swellable material has swelled; and causing or allowing the swellable material to swell.

2. The method according to claim 1, wherein the cased wellbore is a primary wellbore or a lateral wellbore.

3. The method according to claim 1, wherein the mill diverter further comprises a mechanism.

4. The method according to claim 3, wherein the mechanism is a setting mechanism.

5. The method according to claim 3, wherein the swellable material is positioned circumferentially around the body of the mill diverter at a location between the tapered face and the mechanism.

6. The method according to claim 1, wherein the mill diverter further comprises two or more swellable materials.

7. The method according to claim 1, wherein the swellable material swells in the presence of a hydrocarbon liquid or swells in the presence of an aqueous liquid.

8. The method according to claim 7, wherein the swellable material is a hydrocarbon liquid swellable material, and the swellable material is selected from the group consisting of natural rubbers, nitrile rubbers, hydrogenated nitrile rubber, acrylate butadiene rubbers, polyacrylate rubbers, isoprene rubbers, chloroprene rubbers, butyl rubbers (IIR), brominated butyl rubbers (BIIR), chlorinated butyl rubbers (CIIR), chlorinated polyethylenes (CM/CPE), neoprene rubbers (CR), styrene butadiene copolymer rubbers (SBR), sulphonated polyethylenes (CSM), ethylene acrylate rubbers (EAM/AEM), epichlorohydrin ethylene oxide copolymers (CO, ECO), ethylene-propylene rubbers (EPM and EDPM), ethylene-propylene-diene terpolymer rubbers (EPT), ethylene vinyl acetate copolymer, acrylonitrile butadiene rubbers, hydrogenated acrylonitrile butadiene rubbers (HNBR), fluorosilicone rubbers (FVMQ), silicone rubbers (VMQ), poly 2,2,1-bicyclo heptenes (polynorbornene), alkylstyrenes, and combinations thereof.

9. The method according to claim 7, wherein the swellable material is a water-swellable material, and the swellable material is selected from the group consisting of starch-polyacrylate acid graft copolymer and salts thereof, polyethylene oxide polymer, carboxymethyl cellulose type polymers, polyacrylamide, poly(acrylic acid) and salts thereof, poly(acrylic acid-co-acrylamide) and salts thereof, graft-poly(ethylene oxide) of poly(acrylic acid) and salts thereof, poly(2-hydroxyethyl methacrylate), poly(2-hydroxypropyl methacrylate), and combinations thereof.

10. The method according to claim 1, wherein the swelling fluid is a hydrocarbon liquid or an aqueous liquid.

11. The method according to claim 1, wherein the step of causing comprises introducing the swelling fluid into the wellbore, wherein the step of causing is performed after the step of positioning the mill diverter in the wellbore.

12. The method according to claim 1, wherein the swellable material swells at least a sufficient amount such that the swellable material creates a seal in an annulus of the wellbore.

13. The method according to claim 1, wherein the thickness of the swellable material swells at least 5% in volume after coming in contact with the swelling fluid.

14. The method according to claim 1, further comprising the step of forming one or more lateral wellbores after the step of causing or allowing.

15. The method according to claim 14, further comprising the step of removing the mill diverter from the cased wellbore after the step of forming.

16. The method according to claim 1, further comprising the step of producing oil or gas from the subterranean formation after the step of causing or allowing.

17. A method of maintaining a pressure above a mill diverter in a cased wellbore comprising: positioning the mill diverter in the cased wellbore, wherein the mill diverter comprises:

(a) a body;

(b) a tapered face, wherein the tapered face is located at one end of the body;

(c) a fishing mechanism; and (d) a swellable material, wherein the swellable material:

(i) is positioned circumferentially around the body of the mill diverter adjacent to the tapered face and disposed between the tapered face and the fishing mechanism;

(ii) swells in the presence of a swelling fluid; and (iii) prevents a loss of pressure in the cased wellbore at a location above the swellable material after the swellable material has swelled;

causing or allowing the swellable material to swell; and maintaining the pressure in the cased wellbore at a location above the swellable material.

18. The method according to claim 17, wherein the swellable material is capable of withstanding a pressure in the range of about 100 to about 1,500 pounds force per square inch.

19. The method according to claim 17, wherein the step of maintaining comprises introducing a fluid into the cased wellbore.

20. A method of preventing fluid flow past a tapered face of a mill diverter in a cased wellbore comprising:

positioning the mill diverter in the cased wellbore, wherein the mill diverter comprises:

(a) a body;

(b) the tapered face, wherein the tapered face is located at one end of the body;

(c) a fishing mechanism; and (d) a swellable material, wherein the swellable material:

(i) is positioned circumferentially around the body of the mill diverter adjacent to the tapered face and disposed between the tapered face and the fishing mechanism;

(ii) swells in the presence of a swelling fluid; and (iii) prevents a first fluid having a first density from mixing with a second fluid having a second density, wherein the first fluid is located above the swellable material in the cased wellbore and the second fluid is located below the swellable material in the cased wellbore after the swellable material has swelled; and causing or allowing the swellable material to swell.

* * * * *